US010787913B2

(12) United States Patent
Preuss et al.

(10) Patent No.: US 10,787,913 B2
(45) Date of Patent: Sep. 29, 2020

(54) AIRFOIL COOLING CIRCUIT

(71) Applicant: United Technologies Corporation, Farmington, CT (US)

(72) Inventors: Daniel P. Preuss, Newington, CT (US); Brandon W. Spangler, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 119 days.

(21) Appl. No.: 16/177,933

(22) Filed: Nov. 1, 2018

(65) Prior Publication Data

US 2020/0141248 A1 May 7, 2020

(51) Int. Cl.
*F01D 5/18* (2006.01)
*F01D 9/04* (2006.01)

(52) U.S. Cl.
CPC ..... *F01D 5/189* (2013.01); *F01D 9/041* (2013.01); *F05D 2240/121* (2013.01); *F05D 2240/122* (2013.01); *F05D 2260/201* (2013.01); *F05D 2260/22141* (2013.01); *F05D 2300/6033* (2013.01)

(58) Field of Classification Search
CPC ..... F01D 5/187; F01D 5/188; F01D 5/189; F01D 9/065
See application file for complete search history.

(56) References Cited

U.S. PATENT DOCUMENTS 3,799,696 A * 3/1974 Redman ..... F01D 5/189 416/97 R
5,993,156 A * 11/1999 Bailly ..... F01D 5/188 416/96 A
6,874,988 B2 4/2005 Tiemann
7,921,654 B1 4/2011 Liang
8,083,485 B2 * 12/2011 Chon ..... F01D 5/187 416/97 R
9,726,024 B2 8/2017 Buhler et al.
10,443,407 B2 * 10/2019 Briggs ..... F01D 25/12
2017/0175551 A1 6/2017 Waite
2018/0230814 A1 8/2018 Spangler et al.

FOREIGN PATENT DOCUMENTS

EP 1136651 A1 9/2001

OTHER PUBLICATIONS

Extended European Search Report for EP Application No. 19206357.6, dated Jan. 8, 2020, 6 pages.

* cited by examiner

*Primary Examiner* — Justin D Seabe
(74) *Attorney, Agent, or Firm* — Kinney & Lange, P.A.

(57) ABSTRACT

An airfoil for a gas turbine engine includes axial flow and radial flow cooling circuits defined within an airfoil body. A baffle disposed in spaced relation to an inner surface of the airfoil has a plurality of impingement cooling holes configured to direct a cooling fluid at an inner surface of the airfoil body and an axial extent from the leading edge defined by an aft wall, with the axial extent being substantially constant between the inner and outer end walls and defined by a plane perpendicular to an engine axis. A first radially-extending rib is angled with respect to the baffle to define a first passage between the first rib and the baffle that tapers in cross-sectional area between the inner end wall and the outer end wall, becoming larger in cross-sectional area in a direction of cooling fluid flow through the first passage.

20 Claims, 5 Drawing Sheets

AIRFOIL COOLING CIRCUIT

BACKGROUND

The present invention relates generally to cooling components of gas turbine engines and more particularly to cooling circuits for stationary vanes.

Hollow stationary vanes of a turbine section of a gas turbine engine can require internal structures to achieve a desired cooling air flow velocity and heat transfer coefficient with a minimum amount of cooling flow, while limiting deflections or bulging of the airfoil walls resulting from differences in internal and external pressures during operation. Improved cooling circuits are needed to address both heat transfer and bulge requirements while reducing cooling flow requirements.

SUMMARY

An airfoil for a gas turbine engine includes an axial flow cooling circuit defined within an airfoil body and a radial flow cooling circuit defined between the baffle and the trailing edge. The axial flow cooling circuit includes a baffle disposed in spaced relation to an inner surface of the airfoil with a plurality of impingement cooling holes configured to direct a cooling fluid at an inner surface of the airfoil body. The baffle has an axial extent from the leading edge defined by an aft wall with the axial extent being substantially constant between inner and outer end walls and defined by a plane perpendicular to an engine axis. The radial flow cooling circuit includes a first radially-extending rib and a second radially-extending rib. The first rib is angled with respect to the baffle aft wall to define a first passage between the first rib and the baffle that tapers in cross-sectional area between the inner end wall and the outer end wall becoming larger in cross-sectional area in a direction of cooling fluid flow through the first passage.

A method of cooling an airfoil for a gas turbine engine includes flowing cooling fluid through an axial flow cooling circuit and flowing the cooling fluid through the radial flow cooling circuit. The axial flow cooling circuit includes flowing the cooling fluid from a cavity of a baffle through a plurality of cooling holes and directing the flow of cooling fluid from the plurality of cooling holes in an axial direction to a radial cooling circuit defined between the baffle and a trailing edge of the airfoil. The cavity extends between an inner end wall and an outer end wall of the airfoil and has an axial extent from the leading edge defined by an aft wall, with the axial extent being substantially constant between the inner and outer end walls and defined by a plane perpendicular to an engine axis. Flowing the cooling fluid through the radial flow cooling circuit includes flowing the cooling fluid through a first radially-extending passage that tapers outward in cross-sectional area between the inner end wall and the outer end wall in a direction of cooling fluid flow through the first passage, and flowing the cooling fluid through a second radially-extending passage that tapers inward in cross-sectional area between the inner end wall and the outer end wall in a direction of cooling fluid flow through the second passage.

The present summary is provided only by way of example, and not limitation. Other aspects of the present disclosure will be appreciated in view of the entirety of the present disclosure, including the entire text, claims, and accompanying figures.

Figure 1:
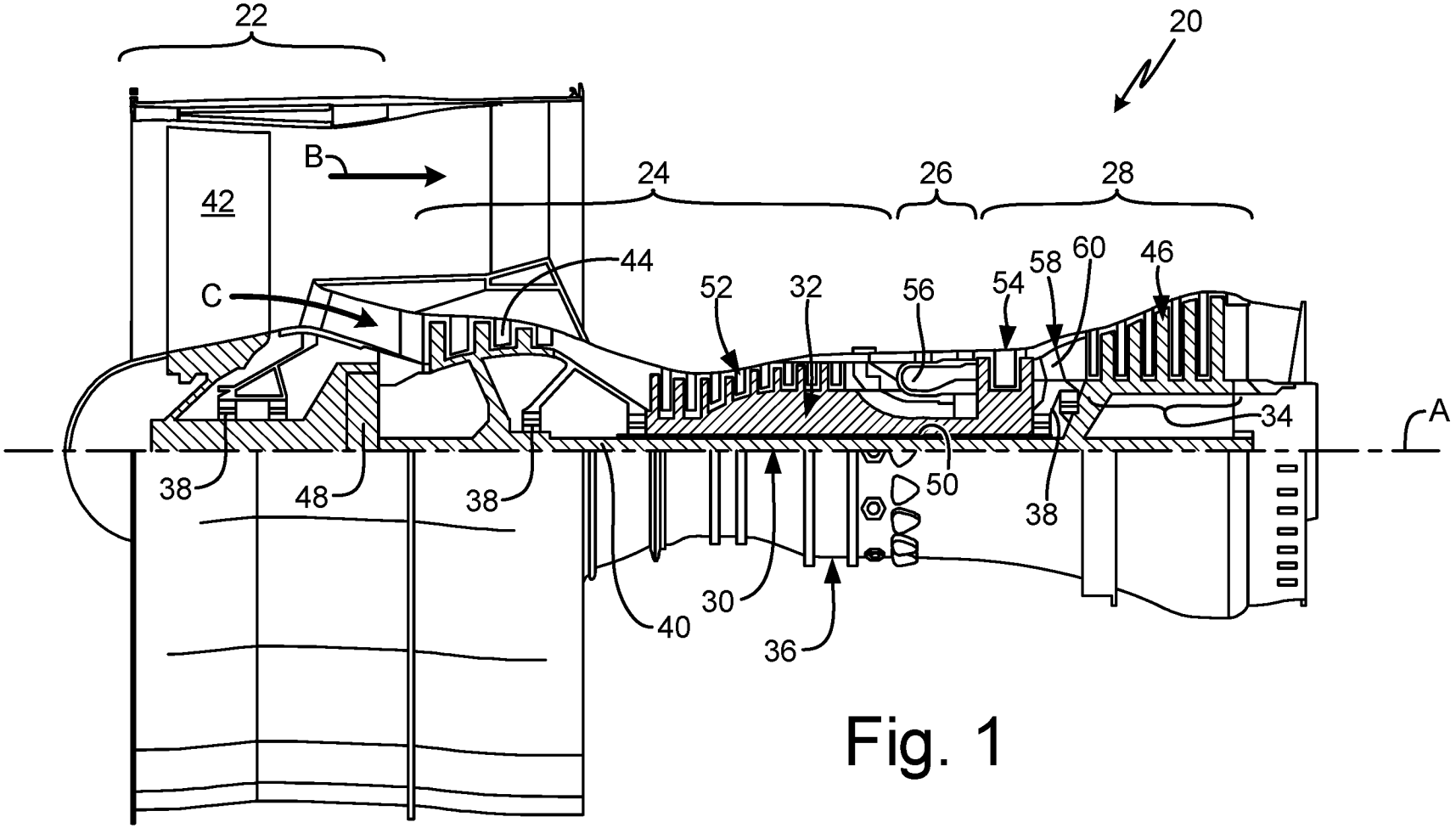
FIG. 1 is a quarter-sectional view of a gas turbine engine.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

FIG. 1 is a quarter-sectional view of a gas turbine engine 20 that includes fan section 22, compressor section 24, combustor section 26 and turbine section 28. Fan section 22 drives air along bypass flow path B while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use with turbofans as the teachings may be applied to other types of turbine engines; for example a low-bypass turbine engine, or a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes low speed spool 30 and high speed spool 32 mounted for rotation about an engine central longitudinal axis A relative to an engine static structure 36 via several bearing systems 38. It should be understood that various bearing systems 38 at various locations may alternatively or additionally be provided.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about engine central longitudinal axis A.

Combustor 56 is arranged between high pressure compressor 52 and high pressure turbine 54. In one example, high pressure turbine 54 includes at least two stages to provide a double stage high pressure turbine 54. In another example, high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 is arranged generally between high pressure turbine 54 and low pressure turbine 46. Mid-turbine frame 58 further supports bearing systems 38 in turbine section 28 as well as setting airflow entering low pressure turbine 46.

The core airflow C is compressed by low pressure compressor 44 then by high pressure compressor 52 mixed with fuel and ignited in combustor 56 to produce high speed exhaust gases that are then expanded through high pressure turbine 54 and low pressure turbine 46. Mid-turbine frame 57 includes airfoils/vanes 60, which are in the core airflow path and function as an inlet guide vane for low pressure turbine 46. Utilizing vanes 60 of mid-turbine frame 58 as inlet guide vanes for low pressure turbine 46 decreases the length of low pressure turbine 46 without increasing the axial length of mid-turbine frame 58. Reducing or eliminating the number of vanes in low pressure turbine 46 shortens the axial length of turbine section 28. Thus, the compactness of gas turbine engine 20 is increased and a higher power density may be achieved.

Each of the compressor section 24 and the turbine section 28 can include alternating rows of rotor assemblies and vane assemblies (shown schematically) that carry airfoils that extend into the core flow path C. To improve efficiency, static outer shroud seals (not shown), such as a blade outer air seal (BOAS), can be located radially outward from rotor airfoils to reduce tip clearance and losses due to tip leakage.

Figure 2:
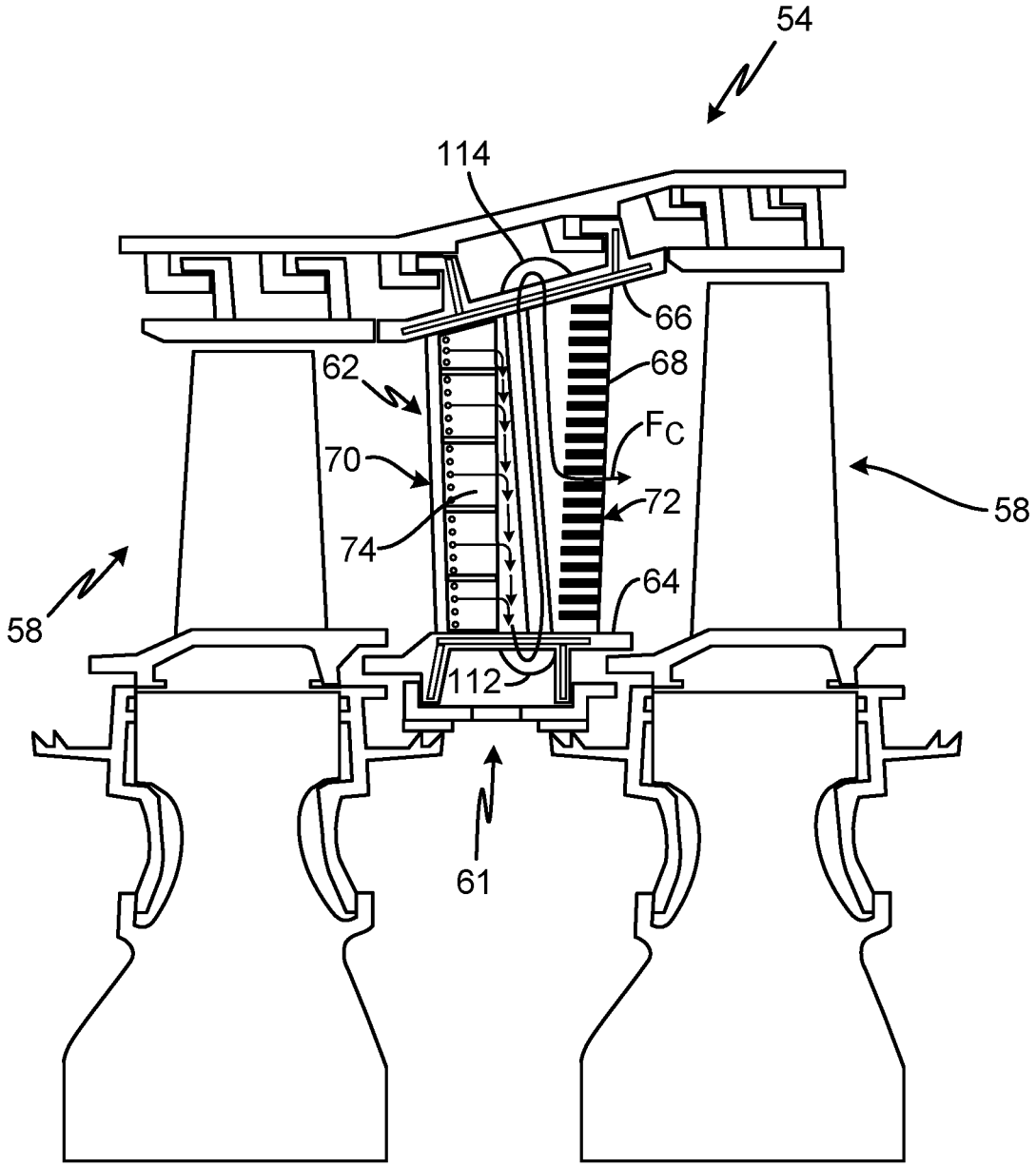
FIG. 2 is a schematized perspective view of a turbine section of the gas turbine engine of FIG. 1.

FIG. 2. is a schematized perspective view of high pressure turbine section 54, which can include alternating rows of rotor assemblies 58 and stationary vane assemblies 61 (only one of which is shown). The illustrated stationary vane assembly 61 includes a plurality of vanes 62. Each vane 62 includes radially inner and outer end walls 64, 66 joined by airfoil body 68 having leading edge 70 and trailing edge 72. Airfoil body 68 includes internal cooling circuit 74, through which cooling fluid $F_c$ can flow (indicated with arrows). Cooling fluid $F_c$ can be provided to vane 62 by any source of cooling fluid, such as bleed air, sourced from a location upstream of stationary vane assembly 61.

Figure 3:
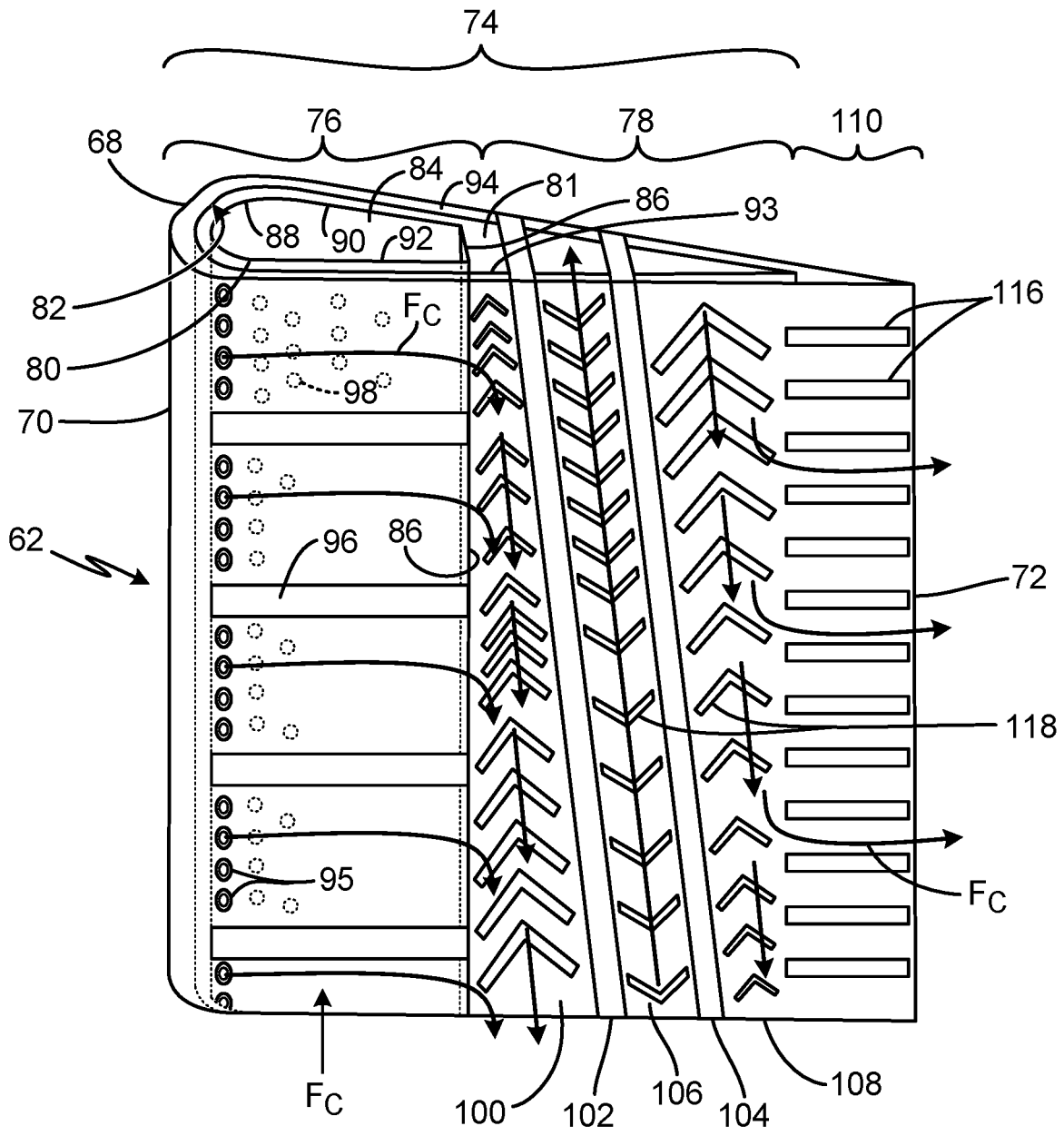
FIG. 3 is a schematized perspective view of one embodiment of a cooling circuit of a stator airfoil of FIG. 2.

FIG. 3 is a schematized perspective view of vane 62 with cooling circuit 74. Cooling circuit 74 includes axial flow cooling circuit 76 and radial flow cooling circuit 78. Axial flow cooling circuit 76 is defined within airfoil body 68 adjacent to leading edge 70 and is configured to cool leading edge 70 and up to 60 percent of chord length of airfoil body 68 from leading edge 70. Radial flow cooling circuit 78 is defined within airfoil body 68 aft of axial flow cooling circuit and is configured to direct cooling fluid $F_c$ through a series of predominantly radially-extending passages before cooling fluid $F_c$ exits airfoil body 68 through trailing edge 72. Axial flow cooling circuit 76 and radial flow cooling circuit 78 are characterized by carrying predominantly axial and radial cooling flow, respectively.

Axial flow cooling circuit 74 includes baffle 80 disposed in airfoil cavity 81 in spaced relation to inner surface 82 of airfoil body 68. Baffle 80 can be formed from a metallic material, ceramic matrix composite (CMC) material, or other suitable material. Baffle 80 is a hollow structure having cavity 84 bounded by a U-shaped wall, which generally corresponds to a shape of inner surface 82, and aft wall 86, which can have a substantially flat surface. U-shaped wall includes a forward edge portion 88, disposed adjacent to and in spaced relation to inner surface 82 along leading edge 70, and opposing side walls 90, 92, disposed adjacent to and in spaced relation to inner surface 82 along the pressure and suction sidewalls 93, 94 of the airfoil, respectively. Baffle 80 is configured to effectively reduce a cross-sectional area of airfoil cavity 81 to increase cooling along leading edge 70. Baffle 80 can be a straight baffle with baffle aft wall 86 extending perpendicularly to inner end wall 64, parallel to leading edge 70, or in a plane perpendicular to engine axis A, such that baffle 80 has an axial extent from leading edge 70 that is substantially constant between inner end wall 64 and outer end wall 66. In some embodiments, a cross-sectional area of baffle cavity 84 can remain substantially constant over the span of the airfoil body 68. The use of a straight baffle allows for a reduction in cross-sectional area of airfoil body cavity 81 over a greater axial extent or airfoil chord length than a small end of a tapering baffle. Baffle 80 can generally extend from adjacent leading edge 70 to 30 percent to 60 percent of the chord length from leading edge 70. Preferably, baffle 80 extends as far axially as possible to reduce the cross-sectional area of airfoil cavity 81. The axial extent of baffle 80 is generally limited by the need for radial ribs to limit bulging or deflections of the airfoil walls.

Baffle 80 includes a plurality of impingement cooling holes 95 positioned along forward edge portion 88 to direct cooling fluid $F_c$ along the inner surface of leading edge 70. Impingement cooling holes 95 can be evenly sized and distributed along a radial length of forward edge portion 88 in one or more radially-extending rows. The size and distribution of impingement cooling holes 95 can be varied in alternative embodiments to tailor impingement cooling as may be necessary to target hot spots along leading edge 70. For example, the density of impingement cooling holes 95 can be increased in regions corresponding to hot spots along leading edge 70. Unlike conventional impingement baffles, aft wall 86 and side walls 90, 92 of baffle 80 are free of impingement cooling holes 95. By limiting impingement cooling holes to the location of forward edge portion 88, baffle 80 can increase heat transfer along leading edge 70 where heat load is highest by focusing all impingement cooling at the inner surface of leading edge 70.

Cooling fluid $F_c$ that impinges upon the inner surface of leading edge 70 is directed axially along inner surface 82 between inner surface 82 and baffle side walls 90, 92. A plurality of axially-extending U-shaped ribs 96 can be disposed along inner surface 82 to channel or direct cooling fluid $F_c$ that has exited impingement cooling holes 95 in an axial direction toward aft wall 86 and radial cooling circuit 78. Ribs 96 can be distributed evenly as a function of span as shown in the embodiments represented in FIGS. 2-4 or can be distributed non-uniformly as a function of span to achieve desired heat transfer at various radial locations along a span of airfoil body 68. Heat transfer can be optimized by spacing ribs 96 to cover regions of interest such that hot regions are cooled and cold regions are not overcooled. Ribs 96 can extend from aft wall 86 along side wall 90, around forward edge region 88, and back to aft wall 86 along side wall 92. Ribs 96 can extend substantially axially along side walls 90, 92. Ribs 96 can be configured to contact forward edge portion 88 and walls 90, 92 of baffle 80 for locating baffle 80 during assembly and to limit radial flow of cooling fluid $F_c$ through axial cooling circuit 76. Ribs 96 can be formed integrally with airfoil body 68 via casting or additive manufacturing methods. In alternative embodiments ribs 96 can be formed on an outer wall of baffle 80.

In some embodiments, a plurality of heat transfer features 98 (shown in phantom) can be disposed along inner surface 82 adjacent one or more side walls 90, 92 to increase heat transfer in the leading edge region of airfoil body 68. FIG. 3 shows these heat transfer features as pedestals, but the heat transfer features could also be trip strips, dimples, or other heat transfer features known in the art. Heat transfer features 98 can be used to move and redistribute cooling fluid $F_c$ and can increase thermal heat transfer through the pressure and suction sidewalls 93, 94 of airfoil body 68. Although illustrated only in a portion of axial cooling circuit 76, heat transfer features 98 can be distributed along the full span of airfoil body 68 along baffle 80. The distribution of heat transfer features 98 can be tailored to address regions of high heat load. For example, the concentration of heat transfer features can be increased in a region near leading edge 70 where heat load is highest and can be decreased over an axial extent toward baffle aft wall 86 as heat load decreases.

Cooling fluid $F_c$ can enter baffle cavity 84 through inner end wall 64, as shown in FIG. 3 (indicated by arrow), or through outer end wall 66. The construction of axial flow cooling circuit 76 and radial flow cooling circuit 78 can remain the same regardless of the direction in which cooling fluid $F_c$ enters baffle cavity 84. Cooling fluid $F_c$ exits baffle cavity 84 through impingement cooling holes 95 and flows axially between adjacent ribs 96 toward baffle aft wall 86 and into first radially-extending passage 100 of radial flow cooling circuit 78. The velocity of cooling fluid $F_c$ between baffle 80 and airfoil body 68 in axial flow cooling circuit 76 can be tailored by modifying the spacing between baffle 80 and the inner surface of airfoil body 68 or by otherwise increasing or decreasing the cross-sectional area through which cooling fluid $F_c$ flows.

Radial flow cooling circuit 78 can be designed to maintain a velocity of cooling fluid $F_c$ exiting axial flow cooling circuit 76. Radial flow cooling circuit 78 includes radially-extending ribs 102, 104, which connect suction and pressure sidewalls of airfoil body 68 to define three cooling fluid passages 100, 106, 108. Radially-extending rib 102 and baffle aft wall 86 define forward passage 100; radially-extending ribs 102 and 104 define central passage 106; and radially-extending rib 104 and trailing edge region 110 define aft passage 108. To maintain cooling flow velocity $F_c$, rib 102 is angled with respect to baffle aft wall 86, such that forward passage 100 tapers in cross-sectional area between inner end wall 64 and outer end wall 66 becoming larger in cross-sectional area in the direction of cooling fluid flow through forward passage 100. As illustrated in FIG. 3, cooling fluid $F_c$ can flow from outer end wall 66 to inner end wall 64. The cross-sectional area of forward passage 100 becomes larger as cooling fluid $F_c$ is added from axial flow cooling circuit 76. As illustrated in FIG. 3, axial flow cooling circuit 76 dumps cooling fluid $F_c$ into forward passage 100 at locations along the airfoil span defined by axially-extending ribs 96 such that a volume of cooling fluid $F_c$ increases in passage 100 from outer end wall 66 to inner end wall 64.

A turn 112 (shown in FIG. 2) connects forward passage 100 to central passage 106 at inner end wall 64 to channel cooling fluid $F_c$ from forward passage 100 to central passage 106. To maintain cooling fluid velocity, central passage 106 can have a substantially uniform cross-sectional shape over the span of the airfoil with rib 102 extending parallel to rib 104. In alternative embodiments, a portion of cooling fluid $F_c$ can be bled off through sidewalls of airfoil body 68 for film cooling of external surfaces of the airfoil. In these embodiments, central passage 106 can be tapered in cross-sectional area to maintain cooling fluid velocity as cooling fluid is bled from central passage 106. As illustrated in FIG. 3, cooling fluid $F_c$ flows through central passage 106 in a direction opposite to cooling fluid flow through forward passage 100, (i.e., from inner end wall 64 to outer end wall 66).

A second turn 114 (shown in FIG. 2) connects central passage 106 to aft passage 108 at outer end wall 66 to channel cooling fluid $F_c$ from central passage 106 to aft passage 108. Aft passage 108 connects radial flow cooling circuit 78 with trailing edge region 110. Trailing edge region 110 includes a plurality of radially-spaced axially-extending ribs 116, which channel cooling fluid $F_c$ from radial flow cooling circuit 78 out of airfoil body 68 at trailing edge 72. As shown in FIG. 3, cooling fluid $F_c$ flows in a substantially radial direction through aft passage 108 from outer end wall 66 to inner end wall 64. As cooling fluid $F_c$ flows through aft passage 108, a portion of cooling fluid $F_c$ is exhausted through trailing edge slots (defined between adjacent ribs 116), flowing in an axial direction between adjacent ribs 116. To maintain cooling fluid velocity through aft passage 108, rib 104 can be angled with respect to trailing edge region 110 (or trailing edge 72) such that aft passage 108 tapers in cross-sectional area between inner end wall 64 and outer end wall 66 becoming smaller in cross-sectional area in the direction of cooling fluid flow through aft passage 108. As illustrated in FIG. 3, cooling fluid $F_c$ flows from outer end wall 66 to inner end wall 64. The cross-sectional area of aft passage 108 becomes smaller as cooling fluid $F_c$ is exhausted through trailing edge region 110. As illustrated in FIG. 3, radial flow cooling circuit 78 exhausts cooling fluid $F_c$ through trailing edge slots at locations along the airfoil span defined by axially-extending ribs 116 such that a volume of cooling fluid $F_c$ decreases in passage 108 from outer end wall 66 to inner end wall 64. In some embodiments, trailing edge region 110 can include axial ribs, oblong pedestals, round pedestals, and combinations thereof (not shown) to direct flow into trailing edge slots and prevent flow separation in trailing edge slots.

Radial flow cooling circuit 78 can include heat transfer features 118 to enhance heat transfer over the length of passages 100, 106, 108. FIG. 3 illustrates chevron-shaped trip strips 118 in each passage 100, 106, and 108 pointing in a direction opposite the flow of cooling fluid $F_c$ and located with non-uniform spacing. As will be understood by one of ordinary skill in the art, heat transfer features 118 can have different shapes, orientations, and spacing, or can otherwise be tailored to address different heat loads at different locations of airfoil body 68. For example, trip strips can be concentrated or more closely spaced in areas of high heat load.

Figure 4:
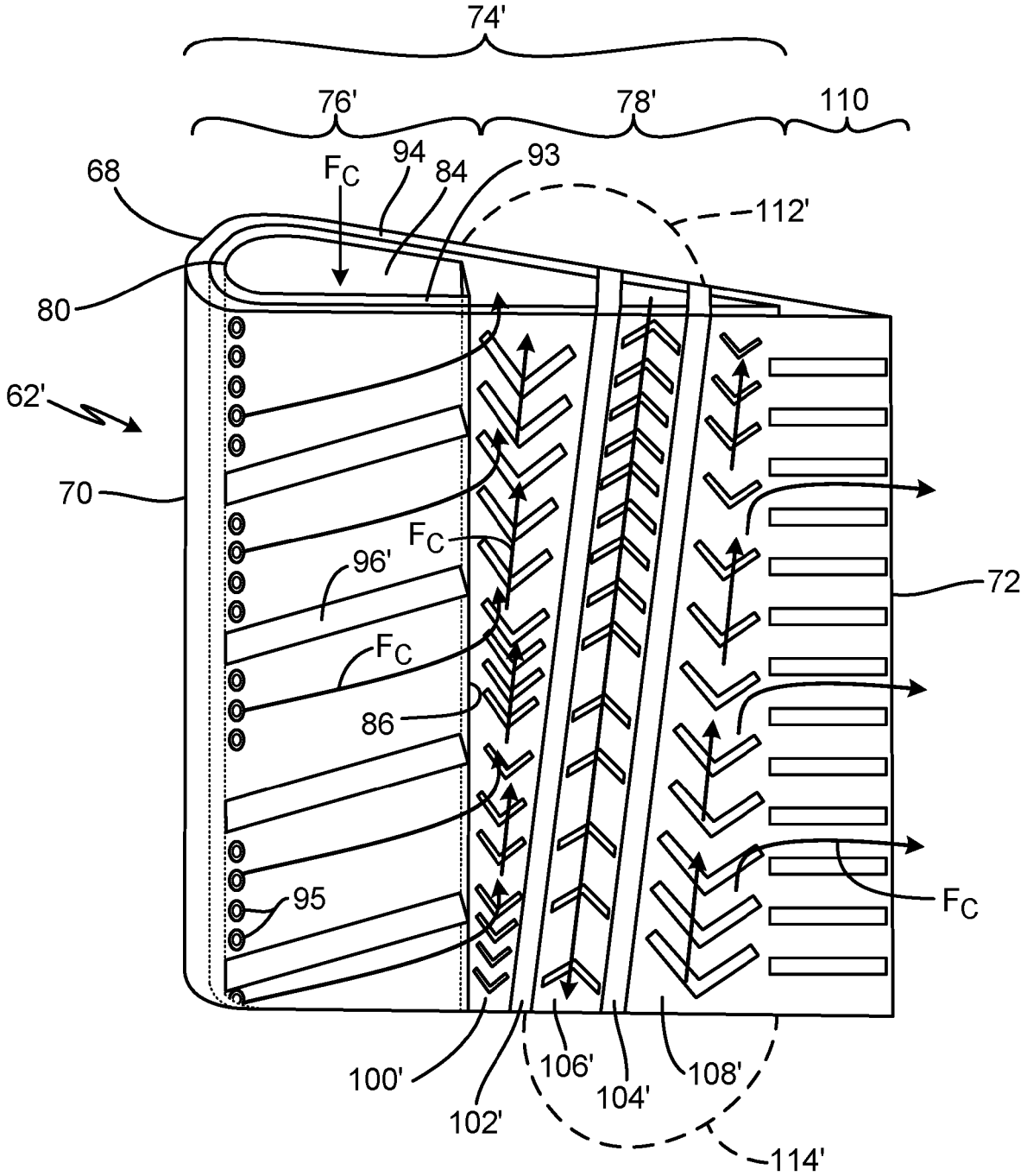
FIG. 4 is a schematized perspective view of another embodiment of a cooling circuit of the stator airfoil of FIG. 2.

FIG. 4 is a schematized perspective view of vane 62 with alternative cooling circuit 74'. Cooling circuit 74' is similar to cooling circuit 74 and, therefore, disclosure pertaining to cooling circuit 74 can be applied to cooling circuit 74' with the modifications disclosed herein. Cooling circuit 74' includes axial flow cooling circuit 76' and radial flow cooling 78'. Like cooling circuit 74, axial flow cooling circuit 76' is defined within airfoil body 68 adjacent to leading edge 70 and is configured to cool leading edge 70 and up to 60 percent of an axial chord length of airfoil body 68 from leading edge 70. Radial flow cooling circuit 78' is defined within airfoil body 68 aft of axial flow cooling circuit and is configured to direct cooling fluid $F_c$ through a series of radially-extending passages before cooling fluid $F_c$ exits airfoil body 68 through trailing edge 72.

Axial flow cooling circuit 76' includes baffle 80 as described with respect to FIG. 3. Axial flow cooling circuit 76' is configured similarly to axial flow cooling circuit 76, but includes modified axially-extending U-shaped ribs 96', which are angled with respect to inner end wall 64, while maintaining a substantially axially-extending orientation. Modified ribs 96' are angled to direct cooling fluid $F_c$ toward a direction of cooling fluid flow through forward passage 100' of radial flow cooling circuit 78' to improve flow dynamics at the intersection of axial flow cooling circuit 76' and radial flow cooling circuit 78'

Cooling fluid $F_c$ can enter baffle cavity 84 through outer end wall 66, as shown in FIG. 4 (indicated by arrow), or through inner end wall 64. The construction of axial flow cooling circuit 76' and radial flow cooling circuit 78' can remain the same regardless of the direction in which cooling fluid $F_c$ enters baffle cavity 84.

Radial flow cooling circuit 78' can be designed to maintain a velocity of cooling fluid $F_c$ exiting axial flow cooling circuit 76' as described with respect to radial flow cooling circuit 78 in FIG. 3. Radial flow cooling circuit 78' includes radially-extending ribs 102', 104', which connect pressure and suction sidewalls 93, 94 of airfoil body 68 to define three cooling fluid passages 100', 106', 108'. Radially-extending rib 102' and baffle aft wall 86 define forward passage 100'; radially-extending ribs 102' and 104' define central passage 106'; and radially-extending rib 104' and trailing edge region 110 define aft passage 108'. To maintain cooling flow velocity $F_c$, rib 102' is angled with respect to baffle aft wall 86, such that forward passage 100' tapers in cross-sectional area between inner end wall 64 and outer end wall 66 becoming larger in cross-sectional area in the direction of cooling fluid flow through forward passage 100'. As illustrated in FIG. 4, cooling fluid $F_c$ can flow through forward passage 100' from inner end wall 64 to outer end wall 66. To accommodate the addition of cooling fluid $F_c$ into forward passage 100', the cross-sectional area of forward passage 100' tapers outward from inner end wall 64 to outer end wall 66.

Modified turn 112' (shown in phantom) connects forward passage 100' to central passage 106' at outer end wall 66 to channel cooling fluid $F_c$ from forward passage 100' to central passage 106'. As disclosed with respect to radial flow cooling circuit 78 of FIG. 3, central passage 106' can be configured to maintain the cooling fluid velocity. As illustrated in FIG. 4, cooling fluid $F_c$ flows through central passage 106' in a direction opposite to flow through forward passage 100', from outer end wall 66 to inner end wall 64. Modified turn 114' (shown in phantom) connects central passage 106' to aft passage 108' at inner end wall 64 to channel cooling fluid $F_c$ from central passage 106' to aft passage 108'. Aft passage 108' connects radial flow cooling circuit 78' with trailing edge region 110, which exhausts air from radial flow cooling circuit 78' as described with respect to radial flow cooling circuit 78. As illustrated in FIG. 4, cooling fluid $F_c$ flows through aft passage 108' from inner end wall 64 to outer end wall 66. To maintain cooling fluid velocity, the cross-sectional area of aft passage 108' becomes smaller as cooling fluid $F_c$ is exhausted through trailing edge region 110.

Figure 5:
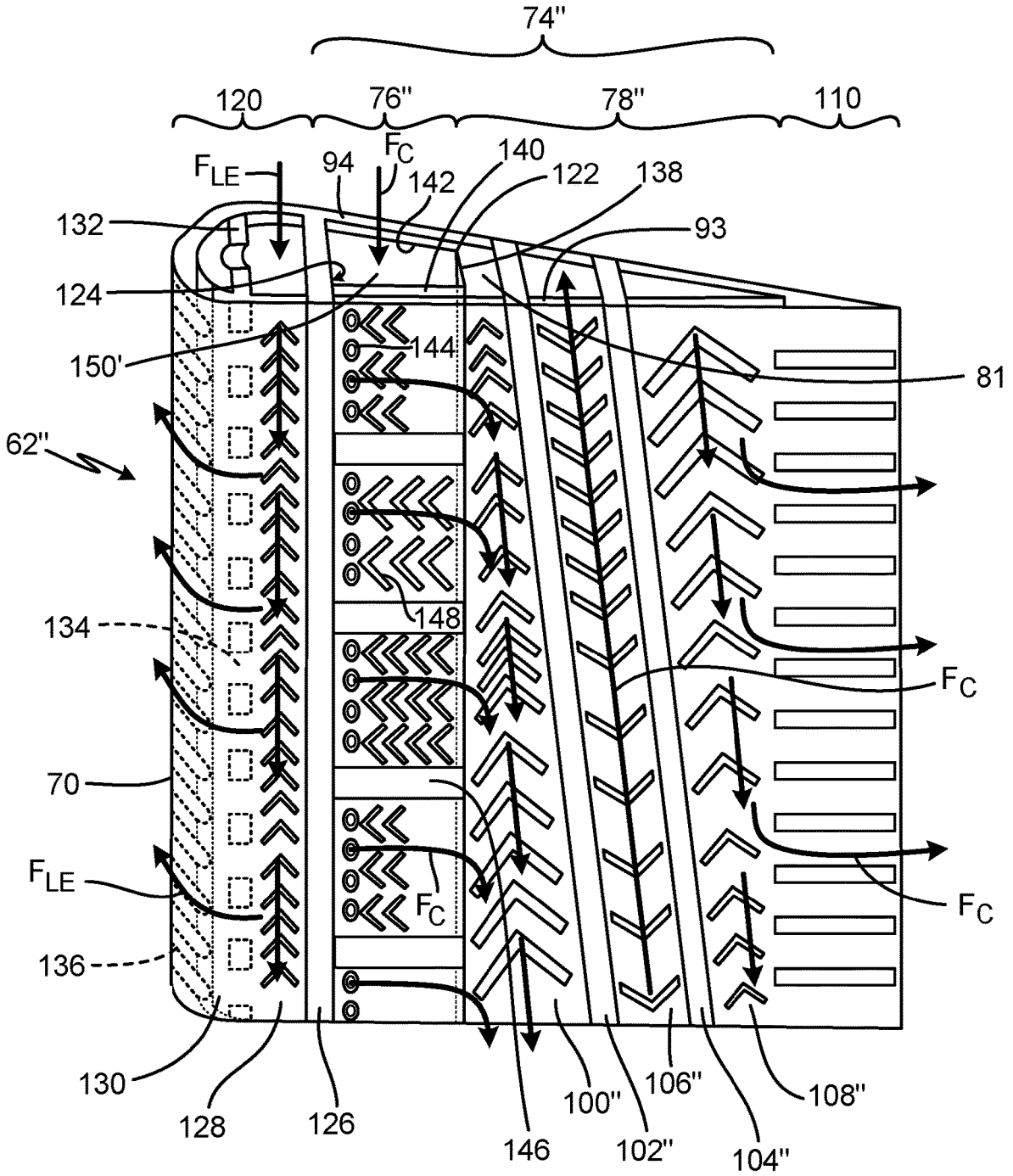
FIG. 5 is a schematized perspective view of yet another embodiment of a cooling circuit of a stator airfoil.

Baffle placement is not limited to the leading edge cavity and baffle shape is not limited to the shape shown FIGS. 2-4. In some embodiments, the baffle can be located aft of and separate from an airfoil leading edge cooling circuit and can have a shape corresponding to the location of placement. FIG. 5 is a schematized perspective view of another embodiment of a cooling circuit of a stator airfoil in which the baffle is spaced apart from a leading edge cooling circuit. FIG. 5 shows vane 62", which can replace vanes 62, 62' of the disclosed gas turbine engine. Similar to stator vanes 62, 62', vane 62" has cooling circuit 74", which includes axial flow cooling circuit 76" and radial flow cooling circuit 78". In addition, vane 62" includes leading edge cooling circuit 120. Axial and radial flow cooling circuits 76", 78" are similar in design to the axial and radial flow cooling circuits 76, 76', 78, 78' disclosed in FIGS. 2-4, with the exception of baffle 122, which has a forward wall 124 corresponding to a shape of radially-extending rib 126 of leading edge cooling circuit 120. Vane 62" benefits from the advantages provided by a straight baffle coupled with a tapered radial flow cooling circuit, while providing a separate cooling circuit for leading edge 70.

Leading edge cooling circuit 120 can include radial flow passage 128 and axial flow passage 130 separated by radially-extending rib 132. Radial flow passage 128 is defined by opposing pressure and suction sidewalls 93, 94, and by opposing radially-extending ribs 126 and 132, which connect pressure and suction sidewalls 93, 94 of airfoil body 68 along the span. Radially-extending rib 132 can include a plurality of impingement cooling holes 134, through which cooling air is directed from radial flow passage 128 to axial flow passage 130 to impinge upon the inner surface of leading edge 70 before exiting vane 62" through leading edge cooling holes 136. Leading edge cooling fluid $F_{LE}$ can enter leading edge cooling circuit 120 from outer end wall 66 as shown in FIG. 5 (indicated by arrow) or from inner end wall 64. The use of leading edge cooling circuit 120 provides dedicated cooling to leading edge 70, while axial flow cooling circuit 76" provides cooling to pressure and suction sidewalls 93, 94.

Axial flow cooling circuit 76" includes baffle 122, which can be a straight baffle with both baffle forward wall 124 and baffle aft wall 138 extending perpendicularly to inner end wall 64, parallel to leading edge 70, or in a plane perpendicular to engine axis A, such that baffle 122 has an axial extent from leading edge 70 that is substantially constant between inner end wall 64 and outer end wall 66. In some embodiments, a cross-sectional area of baffle 122 can remain substantially constant over the span of the airfoil body 68. The use of a straight baffle allows for a reduction in cross-sectional area of airfoil body cavity 81 over a greater axial chord length than a small end of a tapering baffle. Baffle 122 can be positioned in close proximity to or abutting radially-extending rib 126 of leading edge cooling circuit 120 with side walls 140, 142 in spaced relation to pressure and suction sidewalls 93, 94 of airfoil body 68, respectively. Baffle 122 can generally extend from radially-extending rib 126 to up to 60 percent of the airfoil chord length from leading edge 70. Preferably, baffle 122 extends as far axially as possible to reduce the cross-sectional area of airfoil cavity 81. The axial extent of baffle 122 is generally limited by the need for radial ribs to limit bulging or deflections of the airfoil walls.

Baffle 122 includes a plurality of impingement cooling holes 144 positioned along opposing side walls 140, 142 to direct cooling air to pressure and suction sidewalls 93, 94, respectively. Impingement cooling holes 144 can be evenly sized and distributed along a radial length of baffle 122 in one or more radially-extending rows. The size and distribution of impingement cooling holes 144 can be varied in alternative embodiments to tailor impingement cooling as may be necessary to target hot spots along the span of airfoil body 68 and pressure and suction sidewalls 93, 94. Generally, the density of impingement cooling holes 144 can be concentrated along side walls 140, 142 toward baffle forward wall 124, with few or no impingement cooling holes 144 in close proximity to baffle aft wall 138. Baffle 122 can be free of impingement cooling holes on forward wall 124 and aft wall 138, as radially-extending rib 126 adjacent to forward wall 124 is cooled by leading edge cooling fluid $F_{LE}$ and baffle aft wall 138 is cooled by radial flow cooling circuit 78"

Cooling fluid $F_c$ that impinges upon the inner surface of pressure and suction sidewalls 93, 94 is directed axially along the inner surface of pressure and suction sidewalls 93, 94 and outer surface of baffle side walls 140, 142. A plurality of axially-extending ribs 146 can be disposed along the inner surface of pressure and suction sidewalls 93, 94 to channel or direct cooling fluid $F_c$ that has exited impingement cooling holes 144 in an axial direction toward aft wall 138 and radial cooling circuit 78". Ribs 146 can be distributed evenly as a function of span as shown in the embodiment represented in FIG. 5 or can be distributed non-uniformly as a function of span to achieve desired heat transfer at various radial locations along a span of airfoil body 68. External heat transfer regions may not be uniform along the airfoil span. Heat transfer can be optimized by spacing ribs to cover a region of interest, such that hot regions are cooled and cold regions are not overcooled. Ribs 146 can extend along pressure and suction sidewalls 93, 94 from baffle forward wall 124 to baffle aft wall 138. Ribs 146 can extend substantially axially along pressure and suction sidewalls 93, 94 or can be angled in a manner consistent with FIG. 4 to direct cooling fluid $F_c$ toward a direction of cooling fluid flow through forward passage 100" of radial flow cooling circuit 78". Ribs 146 can be configured to contact side walls 140, 142 of baffle 122 for locating baffle 122 during assembly and to limit radial flow of cooling fluid $F_c$ through axial cooling circuit 76". Ribs 146 can be formed integrally with airfoil body 68 via casting or additive manufacturing methods. In alternative embodiments ribs 144 can be formed on an outer wall of baffle 122.

In some embodiments, a plurality of heat transfer features 148 can be disposed along the inner surface of pressure and suction sidewalls 93, 94 adjacent one or more baffle side walls 140, 142 to increase heat transfer as needed. FIG. 5 shows these heat transfer features as chevron-shaped trip strips, but the heat transfer features could also be pedestals, dimples, trip strips of other shapes, or other heat transfer features known in the art. Heat transfer features 148 can be used to move and redistribute cooling fluid $F_c$ and can increase thermal heat transfer through the pressure and suction sidewalls 93, 94 of airfoil body 68. The distribution of heat transfer features 148 can be tailored to address regions of high heat load.

Cooling fluid $F_c$ can enter baffle cavity 150 through outer end wall 66, as shown in FIG. 5 (indicated by arrow), or through inner end wall 64. The construction of axial flow cooling circuit 76" and radial flow cooling circuit 78" can remain the same regardless of the direction in which cooling fluid $F_c$ enters baffle cavity 150. Cooling fluid $F_c$ exits baffle cavity 150 through impingement cooling holes 144 and flows axially between adjacent ribs 146 toward baffle aft wall 138 and into first radially-extending passage 100" of radial flow cooling circuit 78". The velocity of cooling fluid $F_c$ between baffle 122 and airfoil body 68 in axial flow cooling circuit 76" can be tailored by modifying the spacing between baffle 122 and the inner surface of airfoil body 68 or by otherwise increasing or decreasing the cross-sectional area through which cooling fluid $F_c$ flows.

Radial flow cooling circuit 78" can be designed to maintain a velocity of cooling fluid $F_c$ exiting axial flow cooling circuit 76" as described with respect to radial flow cooling circuits 78 and 78'. Radial flow cooling circuit 78" includes radially-extending ribs 102", 104", which connect pressure and suction sidewalls 93, 94 of airfoil body 68 to define three cooling fluid passages 100", 106", 108". Radially-extending rib 102" and baffle aft wall 138 define forward passage 100"; radially-extending ribs 102" and 104" define central passage 106"; and radially-extending rib 104" and trailing edge region 110 define aft passage 108". To maintain cooling flow velocity $F_c$, rib 102" is angled with respect to baffle aft wall 138, such that forward passage 100" tapers in cross-sectional area between inner end wall 64 and outer end wall 66 becoming larger in cross-sectional area in the direction of cooling fluid flow through forward passage 100". As illustrated in FIG. 5, cooling fluid $F_c$ can flow through forward passage 100" from outer end wall 66 to inner end wall 64. To accommodate the addition of cooling fluid $F_c$ into forward passage 100", the cross-sectional area of forward passage 100" tapers outward from outer end wall 66 to inner end wall 64.

Radial flow cooling circuit 78" can have turns consistent with turns 112, 114, as described with respect to FIGS. 2 and 3 to form a serpentine cooling flow pathway. As disclosed with respect to radial flow cooling circuit 78 of FIG. 3, central passage 106" can be configured to maintain the cooling fluid velocity. As illustrated in FIG. 5, cooling fluid $F_c$ flows through central passage 106" in a direction opposite to flow through forward passage 100", from inner end wall 64 to outer end wall 66. Aft passage 108" connects radial flow cooling circuit 78" with trailing edge region 110, which exhausts air from radial flow cooling circuit 78" as described with respect to radial flow cooling circuit 78. As illustrated in FIG. 5, cooling fluid $F_c$ flows through aft passage 108" from outer end wall 66 to inner end wall 64. To maintain cooling fluid velocity, the cross-sectional area of aft passage 108" becomes smaller as cooling fluid $F_c$ is exhausted through trailing edge region 110.

The disclosed cooling circuit with straight baffle 80 and tapered radial flow passages addresses both heat transfer and bulge requirements while reducing cooling flow requirements. As disclosed herein, the cooling circuit is customizable and can be adapted to a variety of airfoil configurations. While the disclosed cooling circuit has been described with respect to a turbine vane, it should be understood that that it can be used for other types of vanes, as well as rotor blades.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

Discussion of Possible Embodiments

The following are non-exclusive descriptions of possible embodiments of the present invention.

An airfoil for a gas turbine engine includes an airfoil body having a leading edge, a trailing edge, an inner end wall, and an outer end wall, an axial flow cooling circuit defined within the airfoil body, and a radial flow cooling circuit defined between the baffle and the trailing edge. The axial flow cooling circuit includes a baffle disposed in spaced relation to an inner surface of the airfoil. The baffle has an axial extent from the leading edge defined by an aft wall with the axial extent being substantially constant between the inner and outer end walls and defined by a plane perpendicular to an engine axis. The baffle also includes a plurality of impingement cooling holes configured to direct a cooling fluid at an inner surface of the airfoil body. The radial flow cooling circuit includes a first radially-extending rib and a second radially-extending rib. The first rib is angled with respect to the baffle aft wall to define a first passage between the first rib and the baffle that tapers in cross-sectional area between the inner end wall and the outer end wall becoming larger in cross-sectional area in a direction of cooling fluid flow through the first passage.

The airfoil of the preceding paragraph can optionally include, additionally and/or alternatively, any one or more of the following features, configurations and/or additional components:

The airfoil of any of the preceding paragraphs, wherein the second rib can be positioned between the first rib and the trailing edge, and wherein the second rib can be angled with respect to the trailing edge to define a second passage between the second rib and the trailing edge that tapers in cross-sectional area between the inner end wall and the outer end wall becoming smaller in cross-sectional area in a direction of cooling fluid flow through the second passage.

The airfoil of any of the preceding paragraphs, wherein the baffle can further include a U-shaped wall together with the aft wall defining a central cavity, with the U-shaped wall having a forward edge portion proximate the leading edge of the airfoil and having the plurality of impingement cooling holes positioned to direct cooling fluid flow at an inner surface of the leading edge of the airfoil, a first side extending between the forward edge portion and the aft side, and a second side opposite the first side and extending between the forward edge portion and the aft side. The first side, the second side, and the aft wall can be free of impingement cooling holes.

The airfoil of any of the preceding paragraphs, can further include a forward wall free of impingement cooling holes, an aft wall opposite the forward wall with the aft wall being free of impingement cooling holes, and first and second opposing side walls separating the forward and aft walls. At least one of the first and second side walls includes the plurality of impingement cooling holes configured to direct cooling fluid flow at an inner surface of a pressure side or suction side of the airfoil.

The airfoil of any of the preceding paragraphs, wherein the inner surface of the airfoil can include a plurality of substantially axially-extending ribs configured to direct cooling fluid flow exiting the plurality of impingement cooling holes in an axial direction toward the first passage.

The airfoil of any of the preceding paragraphs, wherein the plurality of substantially axially-extending ribs can extend along the inner surface of the airfoil around a U-shaped wall of the baffle, extending from the aft wall of the baffle on a first side to the aft wall of the baffle on a second side opposite the first side.

The airfoil of any of the preceding paragraphs, wherein the plurality of substantially axially-extending ribs can be angled with respect to the inner end wall to direct cooling fluid flow toward a direction of cooling fluid flow in the first passage.

The airfoil of any of the preceding paragraphs, wherein the plurality of substantially axially-extending ribs can be non-uniformly distributed as a function of span between the inner and outer end walls.

The airfoil of any of the preceding paragraphs can further include a third passage defined between the first radially-extending rib and the second radially-extending rib, a first turn connecting the first passage and the third passage at one of the inner end wall and the outer end wall, and a second turn connecting the second passage and the third passage at the other of the inner end wall and outer end wall.

The airfoil of any of the preceding paragraphs, wherein the first passage can taper inward from the inner end wall to the outer end wall and the second passage can taper outward from the inner end wall to the outer end wall, and wherein the radial flow cooling circuit is configured to direct cooling fluid flow from the outer end wall to the inner end wall in the first and second passages.

The airfoil of any of the preceding paragraphs, wherein the first passage can taper outward from the inner end wall to the outer end wall and the second passage can taper inward from the inner end wall to the outer end wall, and wherein the radial flow cooling circuit is configured to direct cooling fluid flow from the inner end wall to the outer end wall in the first and second passages.

The airfoil of any of the preceding paragraphs can further include a plurality of heat transfer features selected from the group of heat transfer features comprising: first heat transfer features extending from the inner surface of the airfoil toward at least one of the first side of the baffle and the second side of the baffle, and second heat transfer features extending from the inner surface of the airfoil into the first, second, and third passages.

The airfoil of any of the preceding paragraphs, wherein a spacing between adjacent first or second heat transfer features can be non-uniform.

The airfoil of any of the preceding paragraphs, wherein the baffle can include a cavity inlet at the inner end wall or the outer end wall.

The airfoil of any of the preceding paragraphs, wherein the baffle aft wall can be disposed at 30 to 60 percent chord from the leading edge of the airfoil.

A method of cooling an airfoil for a gas turbine engine includes flowing cooling fluid through an axial flow cooling circuit and flowing the cooling fluid through the radial flow cooling circuit. The axial flow cooling circuit includes flowing the cooling fluid from a cavity of a baffle through a plurality of cooling holes and directing the flow of cooling fluid from the plurality of cooling holes in an axial direction to a radial cooling circuit defined between the baffle and a trailing edge of the airfoil. The cavity extends between an inner end wall and an outer end wall of the airfoil and has an axial extent from the leading edge defined by an aft wall, with the axial extent being substantially constant between the inner and outer end walls and defined by a plane perpendicular to an engine axis. Flowing the cooling fluid through the radial flow cooling circuit includes flowing the cooling fluid through a first radially-extending passage that tapers outward in cross-sectional area between the inner end wall and the outer end wall in a direction of cooling fluid flow through the first passage, and flowing the cooling fluid through a second radially-extending passage that tapers inward in cross-sectional area between the inner end wall and the outer end wall in a direction of cooling fluid flow through the second passage.

The method of the preceding paragraph can optionally include, additionally and/or alternatively, any one or more of the following features, configurations, additional components, and/or additional steps:

The method of any of the preceding paragraphs, wherein the first passage can be defined between the baffle and a first rib angled with respect to the baffle and wherein the second passage can be defined between the trailing edge and a second rib angled with respect to the trailing edge.

The method of any of the preceding paragraphs, wherein the flow of cooling fluid can be directed in the axial direction by a plurality of ribs disposed along the inner surface of the airfoil adjacent to the baffle.

The method of any of the preceding paragraphs, wherein the plurality of cooling holes can be located to direct cooling fluid at an inner surface of a leading edge of the airfoil or at inner surfaces of pressure and suction sides of the airfoil.

The method of any of the preceding paragraphs can further include flowing the cooling fluid around a plurality of first heat transfer features disposed between the baffle and the inner surface of the airfoil, and flowing the cooling fluid across a plurality of second heat transfer features disposed in the first and second passages.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An airfoil for a gas turbine engine, the airfoil comprising:

an airfoil body having a leading edge, a trailing edge, an inner end wall, and an outer end wall;

an axial flow cooling circuit defined within the airfoil body, wherein the axial flow cooling circuit comprises a baffle disposed in spaced relation to an inner surface of the airfoil, the baffle having an axial extent from the leading edge defined by an aft wall, the axial extent being substantially constant between the inner and outer end walls and defined by a plane perpendicular to an engine axis, wherein the baffle comprises a plurality of impingement cooling holes configured to direct a cooling fluid at an inner surface of the airfoil body; and a radial flow cooling circuit in fluid communication with the axial flow cooling circuit and defined between the baffle and the trailing edge, the radial flow cooling circuit comprising a first radially-extending rib and a second radially-extending rib, wherein the first radially-extending rib is angled with respect to the baffle aft wall to form a first passage defined by the first radially-extending rib and the aft wall of the baffle and configured to receive cooling fluid from the plurality of impingement cooling holes, the first passage tapering in cross-sectional area between the inner end wall and the outer end wall becoming larger in cross-sectional area in a direction of cooling fluid flow through the first passage.

2. The airfoil of claim 1, wherein the second rib is positioned between the first radially-extending rib and the trailing edge, and wherein the second radially-extending rib is angled with respect to the trailing edge to define a second passage between the second radially-extending rib and the trailing edge that tapers in cross-sectional area between the inner end wall and the outer end wall becoming smaller in cross-sectional area in a direction of cooling fluid flow through the second passage.

3. The airfoil of claim 2, wherein the baffle further comprises:

a U-shaped wall together with the aft wall defining a central cavity, the U-shaped wall comprising:

a forward edge portion proximate the leading edge of the airfoil and having the plurality of impingement cooling holes positioned to direct cooling fluid flow at an inner surface of the leading edge of the airfoil;

a first side extending between the forward edge portion and the aft side; and a second side opposite the first side and extending between the forward edge portion and the aft side;

wherein the first side, the second side, and the aft wall are free of impingement cooling holes.

4. The airfoil of claim 2, wherein the baffle further comprises:

a forward wall free of impingement cooling holes;

an aft wall opposite the forward wall, the aft wall being free of impingement cooling holes; and first and second opposing side walls separating the forward and aft walls, wherein at least one of the first and second side walls comprise the plurality of impingement cooling holes configured to direct cooling fluid flow at an inner surface of a pressure side or suction side of the airfoil.

5. The airfoil of claim 2, wherein the inner surface of the airfoil comprises a plurality of substantially axially-extending ribs configured to direct cooling fluid flow exiting the plurality of impingement cooling holes in an axial direction toward the first passage.

6. The airfoil of claim 5, wherein the plurality of substantially axially-extending ribs extend along the inner surface of the airfoil around a U-shaped wall of the baffle, extending from the aft wall of the baffle on a first side to the aft wall of the baffle on a second side opposite the first side.

7. The airfoil of claim 5, wherein the plurality of substantially axially-extending ribs are angled with respect to the inner end wall to direct cooling fluid flow toward a direction of cooling fluid flow in the first passage.

8. The airfoil of claim 5, wherein the plurality of substantially axially-extending ribs are non-uniformly distributed as a function of span between the inner and outer end walls.

9. The airfoil of claim 5, and further comprising:

a third passage defined between the first radially-extending rib and the second radially-extending rib;

a first turn connecting the first passage and the third passage at one of the inner end wall and the outer end wall; and a second turn connecting the second passage and the third passage at the other of the inner end wall and outer end wall.

10. The airfoil of claim 9, wherein the first passage tapers inward from the inner end wall to the outer end wall and the second passage tapers outward from the inner end wall to the outer end wall, and wherein the radial flow cooling circuit is configured to direct cooling fluid flow from the outer end wall to the inner end wall in the first and second passages.

11. The airfoil of claim 9, wherein the first passage tapers outward from the inner end wall to the outer end wall and the second passage tapers inward from the inner end wall to the outer end wall, and wherein the radial flow cooling circuit is configured to direct cooling fluid flow from the inner end wall to the outer end wall in the first and second passages.

12. The airfoil of claim 9, and further comprising a plurality of heat transfer features selected from the group of heat transfer features comprising:

first heat transfer features extending from the inner surface of the airfoil toward at least one of the first side of the baffle and the second side of the baffle; and second heat transfer features extending from the inner surface of the airfoil into the first, second, and third passages.

13. The airfoil of claim 12, wherein a spacing between adjacent first or second heat transfer features is non-uniform.

14. The airfoil of claim 9, wherein the baffle comprises a cavity inlet at the inner end wall or the outer end wall.

15. The airfoil of claim 9, wherein the baffle aft wall is disposed at 30 to 60 percent chord from the leading edge of the airfoil.

16. A method of cooling an airfoil for a gas turbine engine, the method comprising:

flowing cooling fluid through an axial flow cooling circuit, comprising:

flowing the cooling fluid from a cavity of a baffle through a plurality of cooling holes, wherein the cavity extends between an inner end wall and an outer end wall of the airfoil and has an axial extent from the leading edge defined by an aft wall, with the axial extent being substantially constant between the inner and outer end walls and defined by a plane perpendicular to an engine axis; and directing the flow of cooling fluid from the plurality of cooling holes in an axial direction to a radial cooling circuit defined between the baffle and a trailing edge of the airfoil; and flowing the cooling fluid through the radial flow cooling circuit comprising:

flowing the cooling fluid through a first radially-extending passage that tapers outward in cross-sectional area between the inner end wall and the outer end wall in a direction of cooling fluid flow through the first passage; and flowing the cooling fluid through a second radially-extending passage that tapers inward in cross-sectional area between the inner end wall and the outer end wall in a direction of cooling fluid flow through the second passage.

17. The method of claim 16, wherein the first passage is defined between the baffle and a first rib angled with respect to the baffle and wherein the second passage is defined between the trailing edge and a second rib angled with respect to the trailing edge.

18. The method of claim 17, wherein the flow of cooling fluid is directed in the axial direction by a plurality of ribs disposed along the inner surface of the airfoil adjacent to the baffle.

19. The method of claim 18, wherein the plurality of cooling holes are located to direct cooling fluid at an inner surface of a leading edge of the airfoil or at inner surfaces of pressure and suction sides of the airfoil.

20. The method of claim 18, and further comprising:

flowing the cooling fluid around a plurality of first heat transfer features disposed between the baffle and the inner surface of the airfoil; and flowing the cooling fluid across a plurality of second heat transfer features disposed in the first and second passages.

* * * * *